US011135859B2

(12) United States Patent
Negatu et al.

(10) Patent No.: US 11,135,859 B2
(45) Date of Patent: Oct. 5, 2021

(54) GROUNDING FOR MEDIA

(71) Applicant: Hewlett-Packard Development Company, L.P., Spring, TX (US)

(72) Inventors: Matias Negatu, San Diego, CA (US); Michael A Fairchild, Vancouver, WA (US); Jesse Phillips, San Diego, CA (US); Alexander M Nameroff, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 297 days.

(21) Appl. No.: 16/332,078

(22) PCT Filed: Sep. 12, 2016

(86) PCT No.: PCT/US2016/051329
§ 371 (c)(1),
(2) Date: Mar. 11, 2019

(87) PCT Pub. No.: WO2018/048444
PCT Pub. Date: Mar. 15, 2018

(65) Prior Publication Data

US 2019/0232692 A1 Aug. 1, 2019

(51) Int. Cl.
*B41J 19/00* (2006.01)
*H05F 3/02* (2006.01)
(Continued)

(52) U.S. Cl.
CPC ..... *B41J 19/005* (2013.01); *B41J 11/0015* (2013.01); *B41J 13/103* (2013.01);
(Continued)

(58) Field of Classification Search
CPC .... B41J 19/005; B41J 11/0015; B41J 13/103; B41J 29/00; B65H 1/14; H05F 3/02
See application file for complete search history.

(56) References Cited

U.S. PATENT DOCUMENTS 4,208,141 A 6/1980 Jagger
4,273,323 A * 6/1981 Kaneko ..... B65H 1/18 271/126
(Continued)

FOREIGN PATENT DOCUMENTS

CN 202556923 11/2012
CN 202687558 U 1/2013
(Continued)

*Primary Examiner* — David H Banh
(74) *Attorney, Agent, or Firm* — Dicke Billig & Czaja PLLC

(57) ABSTRACT

Some examples include a grounding system for an image forming apparatus. The grounding system includes a lifting plate having a top surface for storing media and an interface, a cable having a first end and an opposing second end, the first end attached at the interface, a retainer attached to the lifting plate at the interface, the retainer releasably securing the cable to the lifting plate, and a winding spool coupled to the second end of the cable, the winding spool to transfer torque to the cable and to accommodate a length of cable wound around the winding spool. Each of the lifting plate, the cable, and the winding spool are electrically conductive to release electrostatic energy from the media.

15 Claims, 5 Drawing Sheets

(51) Int. Cl.

| | |
|---|---|
| ***B41J 13/10*** | (2006.01) |
| ***B41J 29/00*** | (2006.01) |
| ***B41J 11/00*** | (2006.01) |
| ***B65H 1/14*** | (2006.01) |

(52) U.S. Cl.
CPC ..... *B41J 29/00* (2013.01); *B65H 1/14* (2013.01); *H05F 3/02* (2013.01)

(56) References Cited

U.S. PATENT DOCUMENTS

| | | | | |
|---|---|---|---|---|
| 5,755,157 | A | 5/1998 | Omori et al. | |
| 5,790,933 | A | 8/1998 | Williams | |
| 5,970,296 | A | 10/1999 | Takase | |
| 6,505,829 | B2 * | 1/2003 | Kawata ..... | B65H 31/00 271/208 |
| 8,360,416 | B2 * | 1/2013 | Hayama ..... | B65H 1/14 271/147 |
| 8,777,214 | B2 | 7/2014 | Naoi | |
| 9,122,221 | B2 | 9/2015 | Mizuguchi | |
| 2001/0048191 | A1 * | 12/2001 | Nanba ..... | B65H 29/58 271/303 |
| 2002/0163119 | A1 * | 11/2002 | Kawata ..... | B65H 31/00 271/207 |
| 2004/0041333 | A1 * | 3/2004 | Izumi ..... | G03G 15/6529 271/145 |
| 2011/0103837 | A1 * | 5/2011 | Toyoda ..... | G03G 15/751 399/174 |
| 2013/0069302 | A1 * | 3/2013 | Naoi ..... | B65H 1/14 271/126 |

FOREIGN PATENT DOCUMENTS

| | | |
|---|---|---|
| JP | H0596773 | 4/1993 |
| JP | 05116422 | 5/1993 |
| JP | H0647986 | 2/1994 |
| JP | H07304154 | 11/1995 |
| JP | 2008308245 A | 12/2008 |

* cited by examiner

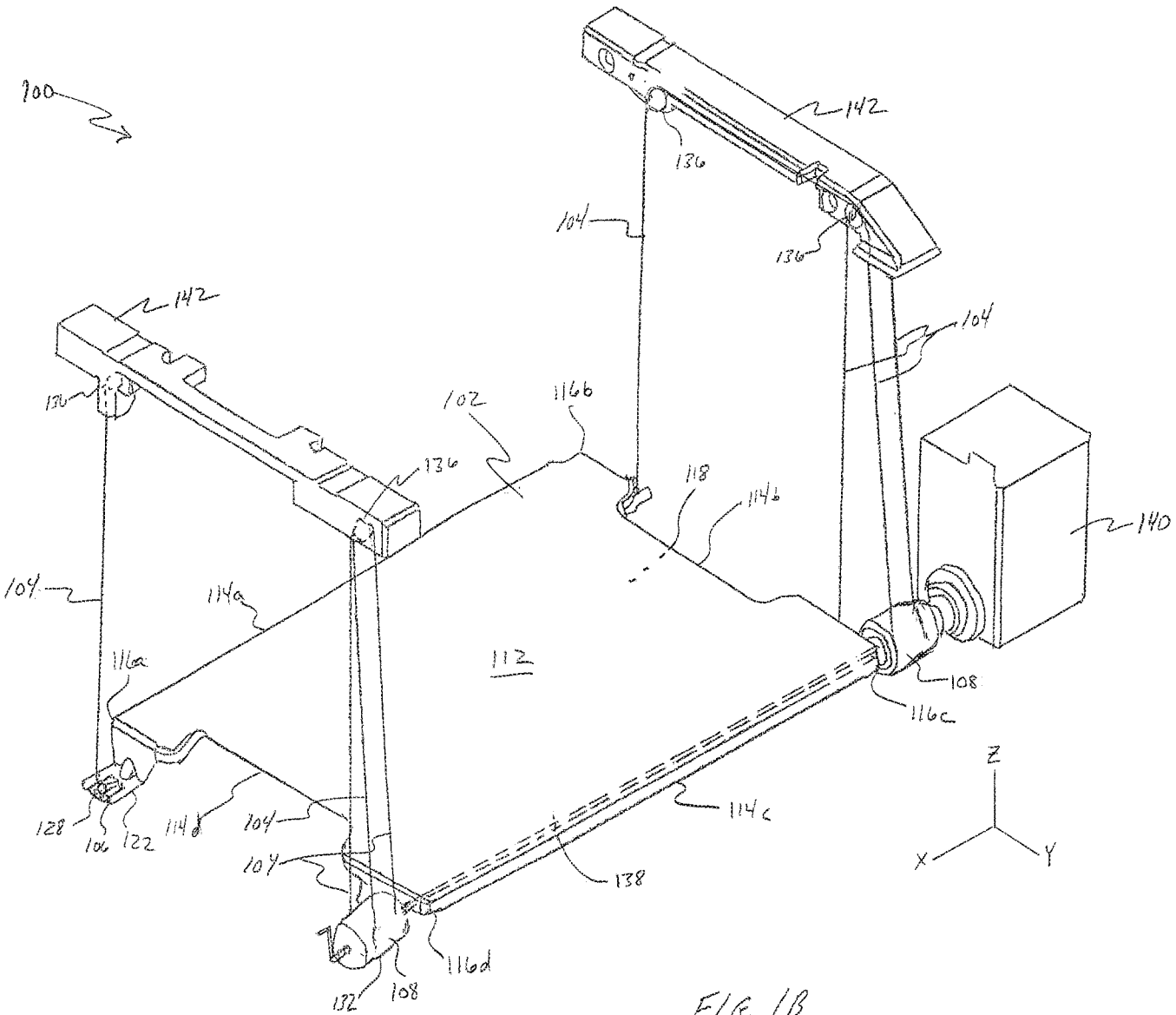
900
142
142
136
136
136
104
104
104

GROUNDING FOR MEDIA

BACKGROUND

An image forming apparatus, such as a copier or a printer that forms an image on a sheet of media often includes a media tray that stores multiple sheets of media until the sheets are fed to an image forming portion of the apparatus. Static electricity is generated by rubbing of sheets in feeding out a sheet from the media tray, and when the static electricity is accumulated in the sheet in the media tray, improper multi-feed of sheets can occur. In the case where a large amount of sheets are stacked, such as in high capacity image forming apparatuses where more than 500 sheets of media can be stored in the media tray, the static electricity can be increased due to the large number of sheets stored and fed through the apparatus.

BRIEF DESCRIPTION OF THE DRAWINGS

FIG. 1B is a perspective view of another grounding system for media useful in an image forming apparatus according to an example of the present disclosure.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

In image forming apparatuses, in particular, high capacity printing devices, static electricity can be generated by the rubbing of media sheets, such as paper, for example, against one another as the sheets are fed to the image forming portion. In a sheet feeder of an image forming apparatus, an uppermost one of the sheets stored is typically fed out by a feed roller. An electrical grounding system that releases the static electricity generated by rubbing of sheets is useful. For example, a grounding system that transfers, or releases, electrostatic charges from the media to the image forming apparatus.

Figure 1A:
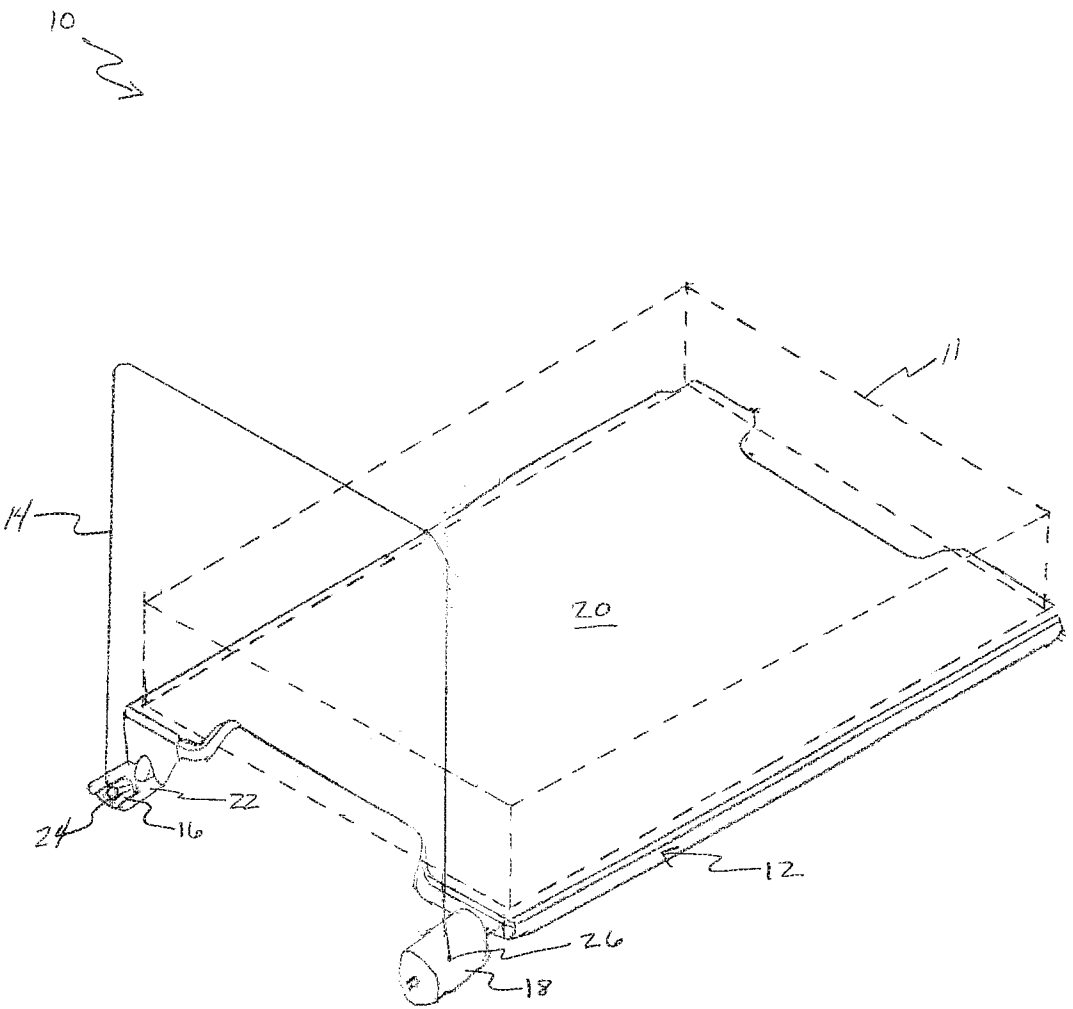
FIG. 1A is a perspective view of a grounding system for media useful in an image forming apparatus according to an example of the present disclosure.

FIG. 1A illustrates is a perspective view of a grounding system 10 for media 11 useful in an image forming apparatus. Grounding system 10 includes a lifting plate 12, a cable 14, a cable retainer 16, and a winding spool 18. Lifting plate 12 includes a top surface 20 for storing media 11 and an interface 22. Cable 14 has a first end 24 and an opposing second end 26. First end 24 is coupled to lifting plate 12 at interface 22. Cable retainer 16 is coupled to interface 22 to releasably secure cable 14 to lifting plate 12 at interface 22. Second end 26 of cable 14 is coupled to winding spool 18. A length of cable 14 can be wound around winding spool 18 upon transfer of torque to cable 14 and raising of lifting plate 12. Lifting plate 12, cable 14, and winding spool 18 are each electrically conductive and provide a conductive path to release electrostatic energy from media 11 as described further below.

FIG. 1B illustrates a perspective view of another grounding system 100 for media useful in an image forming apparatus. Grounding system 100 includes a lifting plate 102, a cable 104, a cable retainer 106, and a lifting system 110 selectively conductively coupled within image forming apparatus. In general, lifting plate 102 forms a platform for stacked sheets of media to be stored prior to printing and for lifting the sheets of media up to a feeding height (position) that each sheet is to be fed to an image forming portion. Lifting plate 102 is raised, or moved upward, by torque applied from lifting system 110 to cable 104 coupled to lifting plate 102. More specifically, cable 104 is attached to lifting plate 102 and is wound around a winding spool 108 to raise lifting plate 102, thereby lifting up the sheets. In accordance with aspects of the present disclosure, lifting plate 102 and lifting system 110 can function for storing and presenting media for processing within image forming apparatus as well as for providing electrostatic grounding of media, as described further below.

Lifting plate 102 is sized and shaped to accommodate a desired shape and size of media to be positioned on a top surface 112 and is of a material of suitable strength and rigidity to support a stack of media (e.g., 500 sheets, 1000 sheets, etc.). Lifting plate 102 is a generally planar rectangular plate with four sides 114*a*, 114*b*, 114*c*, 114*d* defining four corners 116*a*, 116*b*, 116*c*, 116*d* and having top surface 112 and an opposing bottom surface 118. Sides 114*a*, 114*b*, 114*c*, 114*d* of lifting plate 102 can include rolled edges extending generally perpendicular from top and bottom surfaces 112, 118. Lifting plate 102 can be formed of sheet metal, for example, and/or include other material that is electrically conductive. In one example, lifting plate 102 is stamped or otherwise formed of sheet metal into the appropriate shape.

Connection of lifting plate 102 and cable 104 can occur at an interface 122 of lifting plate 102. Lifting plate 102 can be suspended by four cables 104, with one of four cables 104 coupled to one of four interfaces 122, respectively. Any other suitable quantity of cables 104 and interfaces 122 to provide grounding for the media is also acceptable. Each cable 104 couples to interface 122 of lifting plate 102.

Interface 122 can be formed as a right angle extension of lifting plate 102 or can be any other appropriate shape to facilitate coupling of cable 104 to lifting plate 102. In one example, interface 122 is generally L-shaped, extending perpendicularly downward from top surface 112 of lifting plate 102 and then extending outwardly parallel to top surface 112 of lifting plate 102. Interface 122 can be formed to extend from any corner 116*a*, 116*b*, 116*c*, 116*d* or side 114*a*, 114*b*, 114*c*, 114*d* of lifting plate 102. In one example, interface 122 is formed at each corner 114*a*, 114*b*, 114*c*, 114*d* of lifting plate 102. In one example, pairs of interfaces 122 can be oriented to extend in parallel from side 114*d* (i.e., front side) and side 114*b* (i.e., back side) of lifting plate 102, respectively. One or more interface 122 can be formed monolithically with lifting plate 102, such as by stamped sheet metal, for example. Alternatively, interface(s) 122 can be formed separately and attached to lifting plate 102. Regardless, interface(s) 122 are electrically conductive.

Figure 2A:
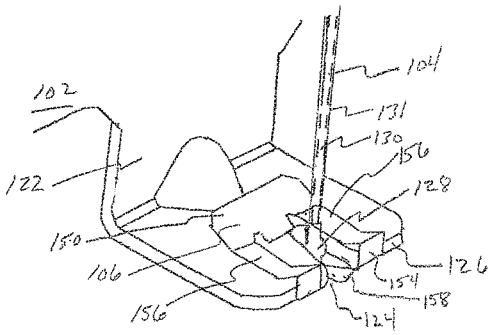
FIG. 2A is an exploded top perspective view of an interface of the grounding system according to the example of FIG. 1B of the present disclosure.
Figure 2B:
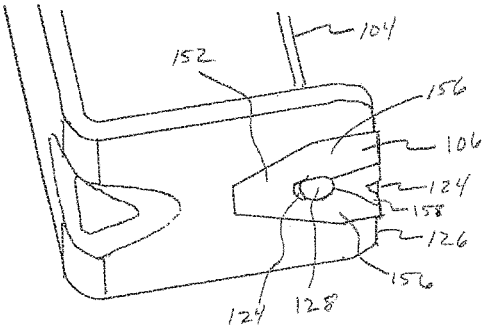
FIG. 2B is an exploded bottom perspective view of an interface of the grounding system according to the example of FIG. 2A of the present disclosure.
Figure 2C:
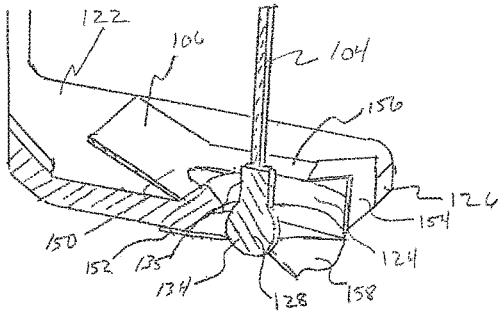
FIG. 2C is an exploded cross-section perspective view of the interface of the grounding system according to the example of FIGS. 2A and 2B of the present disclosure.

With additional reference to the exploded views of interface 122 illustrated in FIGS. 2A-2C, interface 122 can include an opening 124, for example, a slotted opening with an open side formed at an edge 126 of interface 122 to receive cable 104. A first end 128 of cable 104 can be slidably inserted into opening 124 such that cable 104 extends through and within opening 124. Cable 104 includes an electrically conductive wire 130. Wire 130 can be any suitable flexible material capable of conducting electricity and bearing the mechanical operational loads of lifting plate 102 and media 11, such as strand(s) or rod(s) of suitable metal or metal alloy. In a high capacity image forming apparatus, high strength cables, such as aircraft cables, can be employed. Wire 130 of cable 104 is useful in transferring static electricity. A main body, or length, of wire 130 can be sheathed in a non-conductive sheathing 131, such as a plastic, nylon, or other suitable coating, for example. First end 128 and a second end 132 of cable 104 are free of sheathing 131 and are exposed electrically conductive first and second ends 128, 132. First end 128 of cable 104 can include a rounded, or spherical, cap 134 with a shaft 135 extending from cap 134 along cable 104. Shaft 135 can have a diameter, or cross-sectional area, that is greater than a wire 130 of cable 104 and less than cap 134. Cap 134 and shaft 135 are electrically conductive.

Cable retainer 106 can be slidably disposed to at least partially cover, or block, opening 124 such that first end 128 of cable 104 is prevented from inadvertent removal from opening 124. Cable 104 is prevented from disassembly from interface 122 of lifting plate 102 by cable retainer 106. Cable retainer 106 can be slidably assembled to lifting plate 102 at interface 122 to retain cable 104. Cable retainer 106 can be slidably removed from interface 122 to disengage cable 104 from interface 122 if desired. Cable retainer 106 can be disposed over edge 126 of interface 122 and retain first end 128 of cable 104 in conductive relationship with interface 122 of lifting plate 102.

Cable retainer 106 biases first end 128 of cable 104 against interface 122. Cable retainer 106 can be a spring clip having a top portion 150 and a bottom portion 152 that are biased toward one another and an end portion 154 extending between top portion 150 and bottom portion 152. Cable retainer 106, or clip, is open between top and bottom portions 150, 152 opposite end portion 154. In one example, legs 156 of top and bottom portions 150, 152 are joined together opposite end portion 154 and define a channel between legs 156 corresponding to opening 124 of interface 122. Cable retainer 106 can include an extension 158 projecting into channel to at least partially block or cover opening 124. Extension 158 can be biased into channel and into a width of opening 124 of interface 122. In one example, extension 158 projects from each leg 156 and are biased toward one another across channel. Cable retainer 106 can be configured as other forms of fasteners. Cable retainer 106 can be formed of non-conductive or conductive material. For example, cable retainer 106 can be formed of copper alloy or beryllium copper (BeCu) alloy.

With continued reference to FIG. 1B, lifting system 110 can include at least one driving pulley 136, at least one winding spool 108, a drive shaft 138, and a torque generator 140. Driving pulleys 136 are positioned vertically, in a z-axis direction, above lifting plate 102 and can be rotatably housed and supported within a pulley assembly 142. Driving pulleys 142 can each be positioned at an equal, or at approximately an equal, distance from top surface 112 of lifting plate 102. It is desirable to maintain lifting plate 102 in a flat, horizontal orientation during resting, lifting and lowering. In some examples, four cables 104 with corresponding interfaces 122 and driving pulleys 136 are employed in spaced apart positions to maintain lifting plate 102 horizontally. When four cables 104 are employed, for example, driving pulleys 136 are positioned above each of four interfaces 122 of lifting plate 102. Winding spool 108 is positioned to wind up a single cable 104 or pair of cables 104 at each of front and back sides 114*d*, 114*b* of lifting plate 102. For example, cables 104, 104 extends from interfaces 122 at corners 116*a*, 116*b* to driving pulley 136, horizontally from driving pulley 136 to driving pulley 136, and then vertically down to winding spool 108, 108 adjacent to corners 116*c*, 116*d*, respectively. Cables 104 coupled to interfaces 122 at corners 116*c*, 116*d* extend from interfaces 122 to driving pulley 136 positioned vertically above and then back down to winding spool 108 adjacent corners 116*c*, 116*d*. At least one driving pulley 136 is positioned above each one of winding spools 108. Although multiple cables 104, driving pulleys 136, and winding spools 108 are illustrated and discussed with respect to FIG. 1B, it is understood that a single cable 104, driving pulley 136, and winding spool 108 can be employed.

Figure 2D:
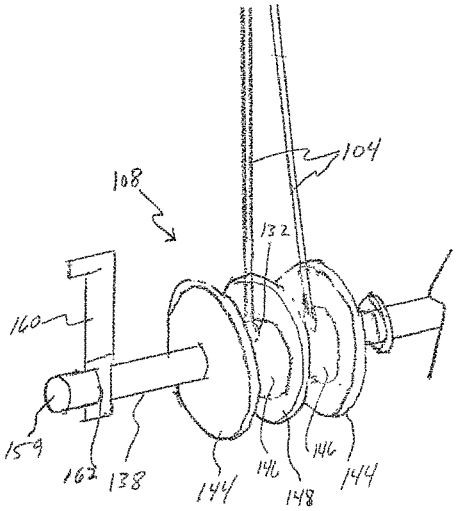
FIG. 2D is an exploded perspective view of a winding spool of the grounding system according to an example of the present disclosure.

FIG. 2D is an exploded perspective view of winding spool 108 in accordance with aspects of the present disclosure. Winding spool 108 is fixedly attached to drive shaft 138 and rotates with drive shaft 138. Winding spool 108 is disposed on drive shaft 138 and extends outside of a perimeter formed by sides 114 of lifting plate 102. Winding spool 108 is generally cylindrical with a longitudinal axis extending along drive shaft 138. Winding spool 108 can include a radial cap 144 at each of opposing ends. In one example, a body 146 of winding spool 108 is formed of a carbon powder filled conductive plastic. Second end 132 of one or a pair of cables 104 is coupled to winding spool 108. In one example, second end 132 includes a spherical cap that is inserted into a slot in body 146. Second end 132 of cable 104 extends within or through body 146 and connects with conductive interior body of winding spool 108. Second end 132 of cable 104 can be thermally welded to body 146 of winding spool 108, for example, or otherwise connected to winding spool 108 in other suitable methods. In one example, winding spool 108 includes a circular mid-ring 148 extending from outer housing between end caps 144. Mid-ring 148 and end caps 144 can have various diameters greater than body 146. In one example, second end 132 can be coupled to winding spool 108 at, or adjacent to, mid-ring 148. Cable 104 is windable around body 146 as torque is applied and lifting plate 102 is raised within media tray. Each cable of a pair of cables 104 can be wound around winding spool 108 on opposing sides of mid-ring 148 to opposing radial end caps 144, respectively.

Drive shaft 138 is positioned under lifting plate 102 adjacent bottom surface 118 and extends between and beyond side 114*d* and side 114*b* of lifting plate 102. In one example, drive shaft 138 extends adjacent to and parallel to a side edge 114*c* of lifting plate 102. Drive shaft 138 is rotatable and extends from torque generator 140 (e.g., a drive assembly with a motor) to a tray chassis (see FIG. 3). Drive shaft 138 extends through winding spool(s) 108 disposed exteriorly adjacent to lifting plate 102, with one winding spool 108 positioned between side 114*b* and torque generator 140. Two winding spools 108 are attached to a common drive shaft 138. Winding spools 108 and drive shaft 138 are integrally rotated together. In this manner, cables 104 move upward and downward while maintaining lifting plate 102 in a horizontal position. Drive shaft 138 is an electrically conductive elongated rod. One end 159 of drive shaft 138 can be coupled to the tray chassis with a conductive clip 160. In one example, clip 160 is a metal spring clip and is mechanically fastened to tray chassis and includes a lumen 162 for end 159 of drive shaft 138 to rotatably couple to clip 160. Other conductive connections, such as conductive plastic bearings, can also be employed to couple drive shaft 138 with the tray chassis.

Figure 3:
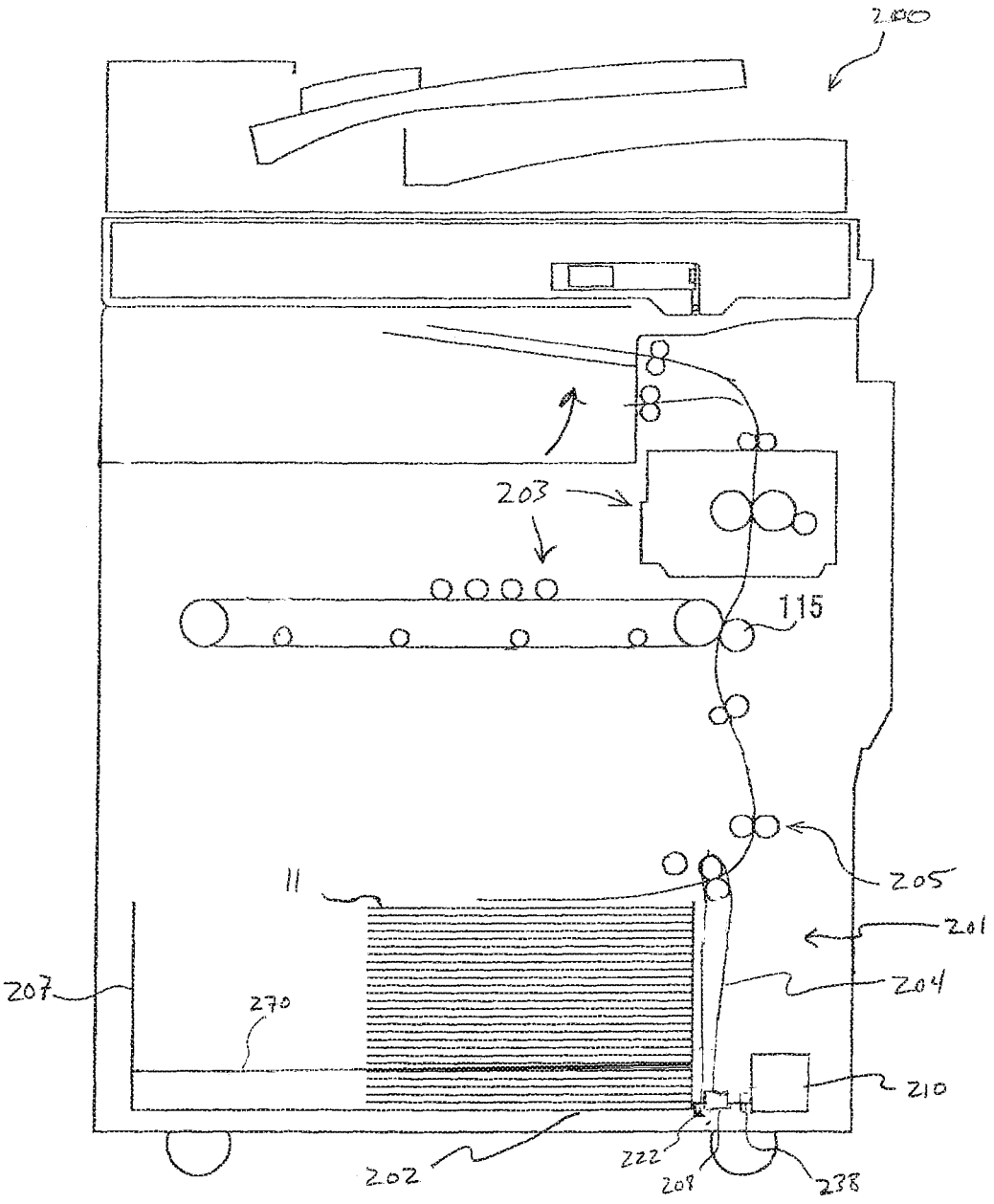
FIG. 3 is a side view schematically illustrating an image forming apparatus including a grounding system according to an example of the present disclosure.

FIG. 3 is a schematic side view of an image forming apparatus 200 including a grounding system 201 according to an example of the present disclosure. Image forming apparatus 200 includes an image forming section 203 and a sheet feeding unit 205. Sheet feeding unit 205 includes a media tray 207 with a lifting plate 202 for storing and supplying sheets one by one to the image forming section 203. Media tray 207 can be pulled out from image forming apparatus 200 to allow a user to replenish a quantity of media 11. More than one media tray 207 can be provided in image forming apparatus 200. For example, two media trays 207 can be provided in tandem (e.g., side-by-side) in some high capacity image forming apparatuses, with each media tray 207 capable of storing at least 500 sheets of media 11. Lifting plate 202 is generally provided at the bottom of media tray 207 to stack media 11 upon. Lifting plate 202 is used to lift up the stacked media 11 until an upper-most one of the sheets is positioned to be fed through image forming apparatus 200 to image forming section 203. Lifting and lowering operations of lifting plate 202 is conducted with a lifting system 210 connected to lifting plate 202 by cables 204 combined with the force of gravity caused by the weight of media 11 on lifting plate 202.

Cable 204 is pulled by the weight of lifting plate 202 in response to lifting plate 202 moving downward from a high position so that winding spools 208 and driving shaft 238 are rotated in a direction to unwind (unreel) cable 204, such as when media tray 207 is opened and sheets of media 11 are placed in media tray 207. Gravity, assisted by torque applied by lifting system 210, is useful in aiding the upward and downward movement of lifting plate 202. Downward movement of lifting plate 202 is generally caused by its own weight and the weight of media 11 stacked thereon. Cable 202 at an initial stage of downward movement is unwound from the high position on winding spool 208. The torque that makes drive shaft 238 rotate by the gravity of lifting plate is applied.

Grounding system 201 is similar to grounding systems 10, 100. Grounding system 201 for media 11 releases electrostatic energy from media 11 stored on, and processed from, lifting plate 202 of media tray 207 by forming a conductive path for releasing electrostatic energy from media 11. Electrostatic energy from media 11 is transferred to lifting plate 202. With the connection of cable 204, interface 222 of lifting plate 202, and cable retainer (see also FIGS. 1A and 1B), electrostatic charge from media sheets 11 stored on lifting plate 202 can flow from lifting plate 202 to cable 204. Electrostatic charge flows through wire of cable 204 to winding spool 208, and from winding spool 208 disposed on drive shaft 238, through drive shaft 238 to a tray chassis 270. Charge from tray chassis 270 can flow to image forming apparatus 200 through linear rail bearings (not shown) or other grounded component of image forming apparatus.

Figure 4:
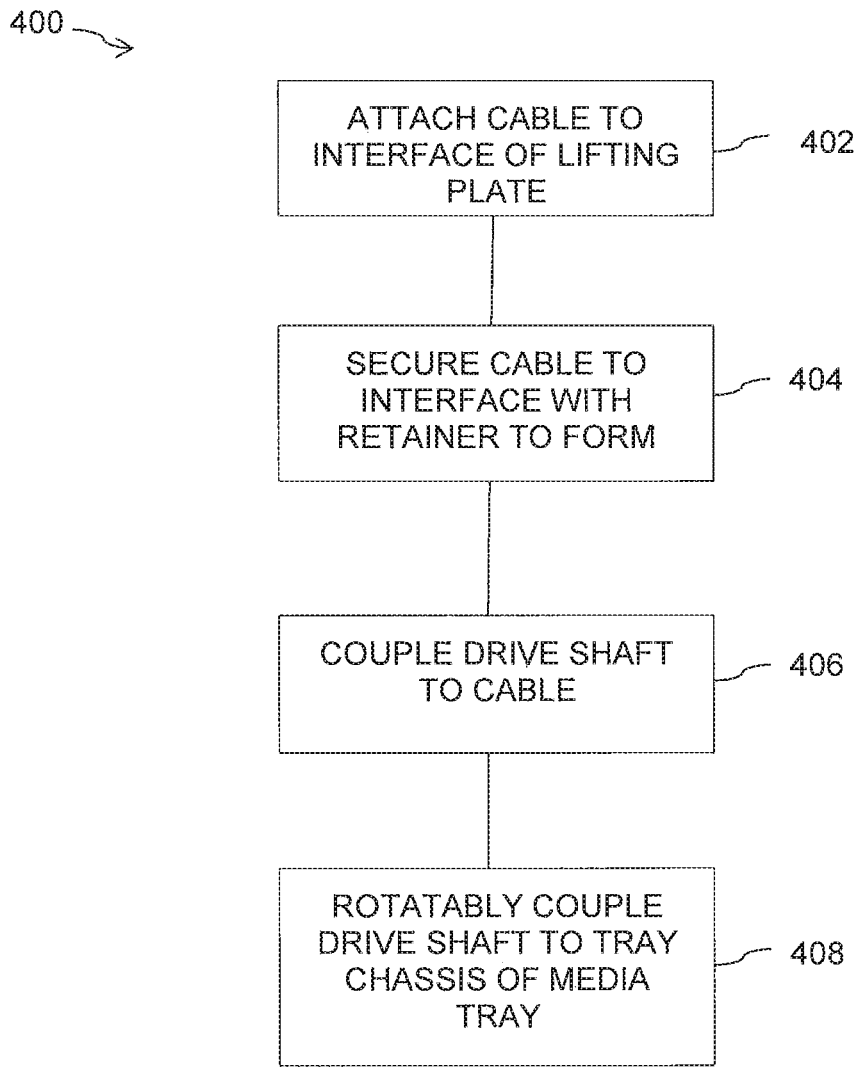
FIG. 4 is a flow chart illustrating an example method of manufacturing a grounding system of an image forming apparatus in accordance with aspects of the present disclosure.

FIG. 4 is a flow chart illustrating an example method of manufacturing 400 a grounding system of an image forming apparatus in accordance with aspects of the present disclosure. At 402, a first end of a cable is attached to a lifting plate at an interface. At 404, the first end of the cable is secured to the interface with a retainer to form a conductive pathway between media to be stored on the lifting plate and the cable. At 406, a drive shaft extending from a torque generator is coupled to the cable. At 408, the drive shaft is rotatably coupled to a tray chassis of a media tray.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A grounding system for an image forming apparatus, the grounding system comprising:

a lifting plate having a top surface for storing media and an interface;

a cable having a first end and an opposing second end, the first end attached at the interface;

a retainer attached to the lifting plate at the interface, the retainer releasably securing the cable to the lifting plate; and a winding spool coupled to the second end of the cable, the winding spool to transfer torque to the cable and to accommodate a length of cable wound around the winding spool, wherein each of the lifting plate, the cable, and the winding spool are electrically conductive and form a conductive path from the lifting plate through the cable to the winding spool to release electrostatic energy from the media.

2. The grounding system of claim 1, wherein the cable includes an electrically conductive wire and a sheathing over the electrically conductive wire, and wherein the cable at the first and second ends is free of the sheathing.

3. The grounding system of claim 2, wherein the first end includes a spherical cap and a shaft extending from the spherical cap along the wire, the shaft having a width greater than the wire and less than the spherical cap.

4. The grounding system of claim 1, wherein the retainer is a spring clip having a top portion to extend on a first surface of the interface, a bottom portion to extend on a second surface opposing the first surface of the interface, and a side portion to extend along an edge of the interface between the first and second surfaces, the retainer including an opening formed by the top, bottom, and side portions and an extension biased to extend into the opening.

5. The grounding system of claim 4, wherein the top portion and the bottom portion are biased toward each other.

6. The grounding system of claim 1, wherein the interface includes a slotted opening, the slotted opening is open at a terminal edge of the interface.

7. The grounding system of claim 6, wherein the retainer extends over at least part of the slotted opening.

8. An image forming apparatus, comprising:

a media tray including a lifting plate and a tray chassis, the lifting plate to support media and present the media for processing in the image forming apparatus;

a cable having a first end and a second end, the first end coupled to the lifting plate at an interface;

a lifting mechanism including a drive shaft, the drive shaft coupled to the tray chassis; and a winding spool disposed on the drive shaft, the winding spool coupled to the second end of the cable, wherein each of the lifting plate, the cable, the drive shaft, and the winding spool are electrically conductive and provide a conductive pathway from the lifting plate through the cable to the winding spool and the drive shaft to ground the media.

9. The image forming apparatus of claim 8, wherein the first end includes a spherical cap with a shaft extending from the spherical cap over an electrically conductive wire of the cable.

10. The image forming apparatus of claim 8, wherein the interface includes a slotted opening having an open side to slidably accommodate attachment of the cable.

11. The image forming apparatus of claim 10, comprising:

a retainer coupled to the interface to extend over the open side and bias the cable toward the lifting plate.

12. A method of manufacturing a grounding system of an image forming apparatus, comprising:

attaching a first end of a cable to a lifting plate at an interface;

securing the first end of the cable to the interface with a retainer; and coupling a second end of the cable to a winding spool disposed on a drive shaft;

wherein attaching the cable to the lifting plate and coupling the cable to the winding spool includes forming a conductive pathway from the lifting plate through the cable to the winding spool and the drive shaft to ground media supported by the lifting plate.

13. The method of claim 12, comprising:

coupling the drive shaft to a chassis of the image forming apparatus.

14. The method of claim 13, wherein coupling the drive shaft to the chassis is with a conductive metal spring.

15. The method of claim 12, wherein the retainer biases the cable to the lifting plate.

* * * * *